US006925956B2

(12) United States Patent
Rocha

(10) Patent No.: US 6,925,956 B2
(45) Date of Patent: Aug. 9, 2005

(54) COLLAPSIBLE WATERCRAFT

(76) Inventor: Mario V. Rocha, 92 W. Swift Ave, Clovis, CA (US) 93612

( * ) Notice: Subject to any disclaimer, the term of this patent is extended or adjusted under 35 U.S.C. 154(b) by 0 days.

(21) Appl. No.: 10/641,731

(22) Filed: Aug. 15, 2003

(65) Prior Publication Data

US 2005/0034649 A1 Feb. 17, 2005

(51) Int. Cl.[7] ..... B63B 7/00

(52) U.S. Cl. ..... 114/353; 114/354; 440/14; 440/15; 440/21

(58) Field of Search ..... 114/353, 354; 440/14, 15, 21

(56) References Cited

U.S. PATENT DOCUMENTS

| | | | | |
|---|---|---|---|---|
| 3,083,382 A | * | 4/1963 | Havens et al. | 114/353 |
| 3,257,987 A | * | 6/1966 | Liard | 440/31 |
| 4,345,903 A | | 8/1982 | Laser | |
| 4,496,325 A | | 1/1985 | Tweg | |
| 5,413,066 A | * | 5/1995 | Spencer, Jr. et al. | 114/354 |
| D374,264 S | | 10/1996 | Peterson | |
| 5,651,706 A | | 7/1997 | Kasper | |
| 5,878,688 A | | 3/1999 | Merrett et al. | |
| 6,077,134 A | | 6/2000 | Lam | |
| 6,083,062 A | | 7/2000 | Treloar et al. | |

FOREIGN PATENT DOCUMENTS

| | | | |
|---|---|---|---|
| GB | 2 181 102 | * | 4/1987 |

* cited by examiner

*Primary Examiner*—Sherman Basinger

(57) ABSTRACT

A collapsible watercraft for personal recreation. The collapsible watercraft includes a tubular frame that has a first portion and a second portion. Each of the portions are generally rectangular and are hingably coupled together allowing them to be folded one portion on top of the other. Two sets of pairs of floatation members are hingably mounted to the frame and are positionable between being adjacent the outer side of the frame for use, and adjacent the inner side of the frame for storage or transit. A human-powered oscillation of a fin member propels the craft. The fin member also serves as a rudder for steering. A foldable seat with a backrest along with a cargo net behind the seat is provided. A canopy is mountable to the frame for protection of the user from the elements.

19 Claims, 5 Drawing Sheets

COLLAPSIBLE WATERCRAFT

BACKGROUND OF THE INVENTION

1. Field of the Invention

The present invention relates to watercraft and more particularly pertains to a new collapsible watercraft for personal recreation.

2. Description of the Prior Art

The use of watercraft is known in the prior art. U.S. Pat. No. 4,496,325 describes a collapsible paddle boat. Another type of watercraft is U.S. Pat. No. 6,083,062 having twin parallel hulls, a frame and human-powered paddlewheels outboard of the two hulls.

SUMMARY OF THE INVENTION

The present invention generally comprises a tubular frame that has a first portion and a second portion. Each of the portions are generally rectangular and are hingably coupled together allowing them to be folded one portion on top of the other.

Two sets of pairs of floatation members are hingably mounted to the frame and are positionable between being adjacent the outer side of the frame for use, and adjacent the inner side of the frame for storage or transit.

An human-powered oscillation of a fin member propels the craft. The fin member also serves as a rudder for steering.

A foldable seat with a backrest along with a cargo net behind the seat is provided.

A canopy is mountable to the frame for protection of the user from the elements.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
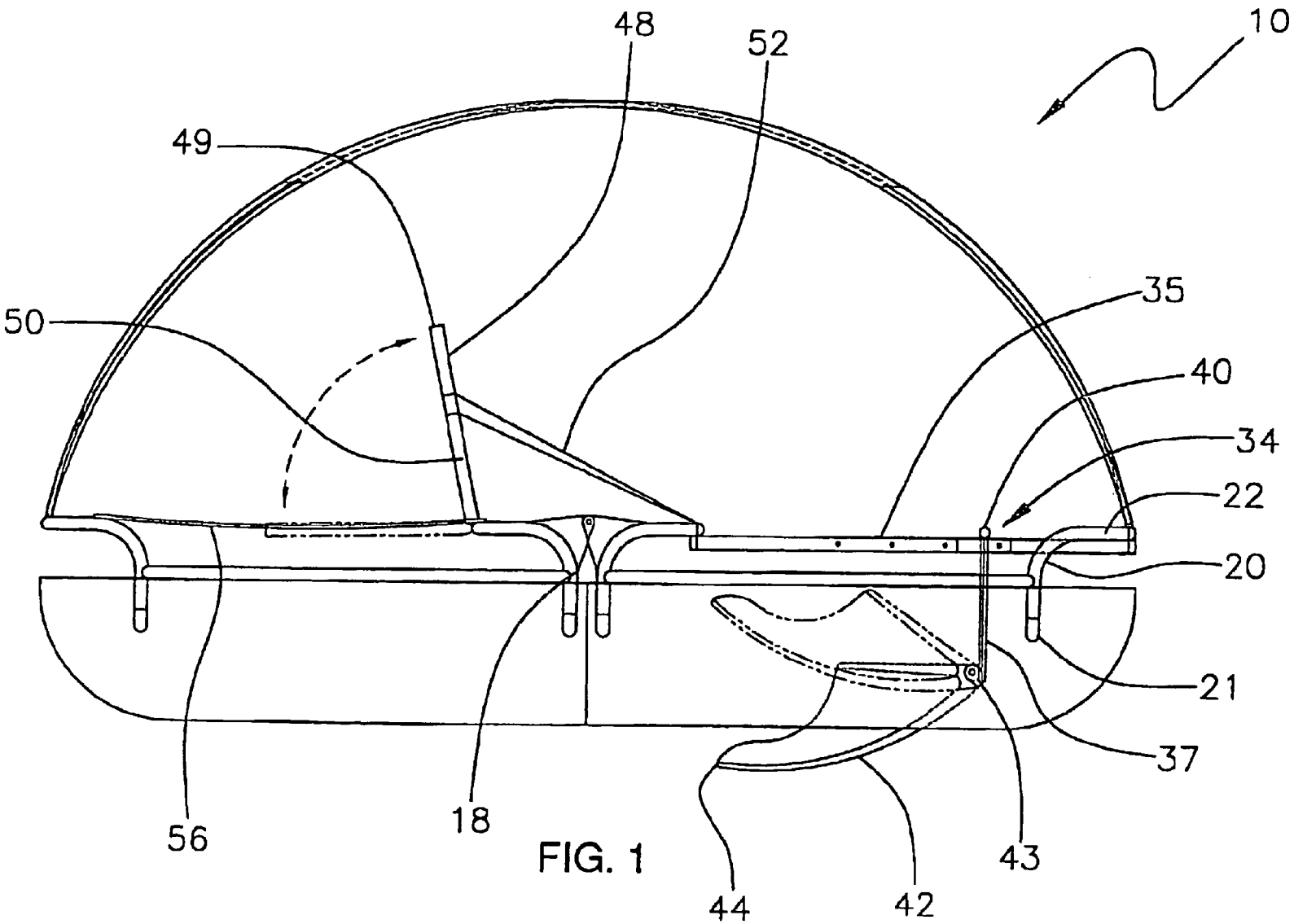
FIG. 1 is a schematic side view of a new collapsible watercraft according to the present invention.
Figure 2:
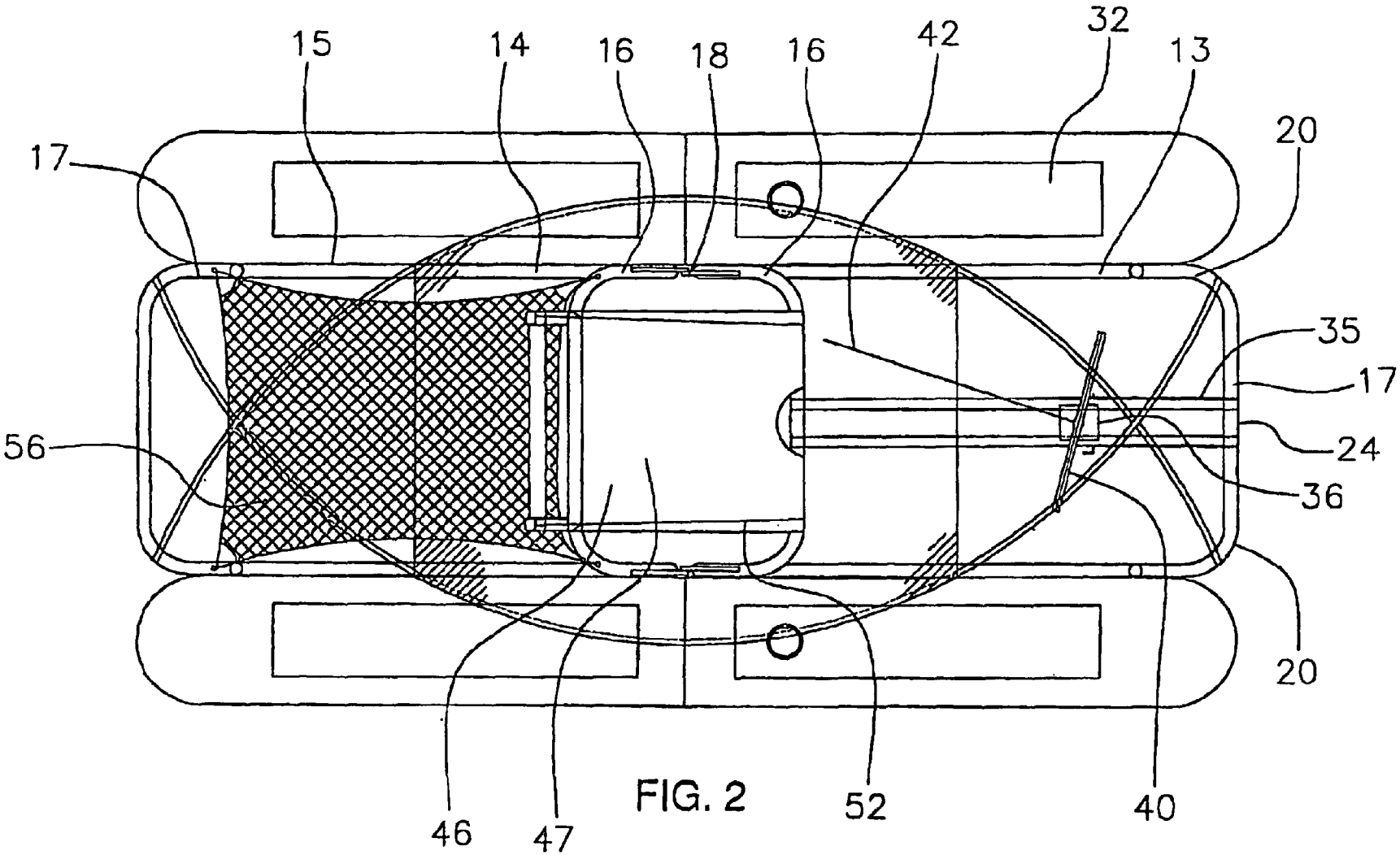
FIG. 2 is a schematic top view of the present invention.
Figure 3:
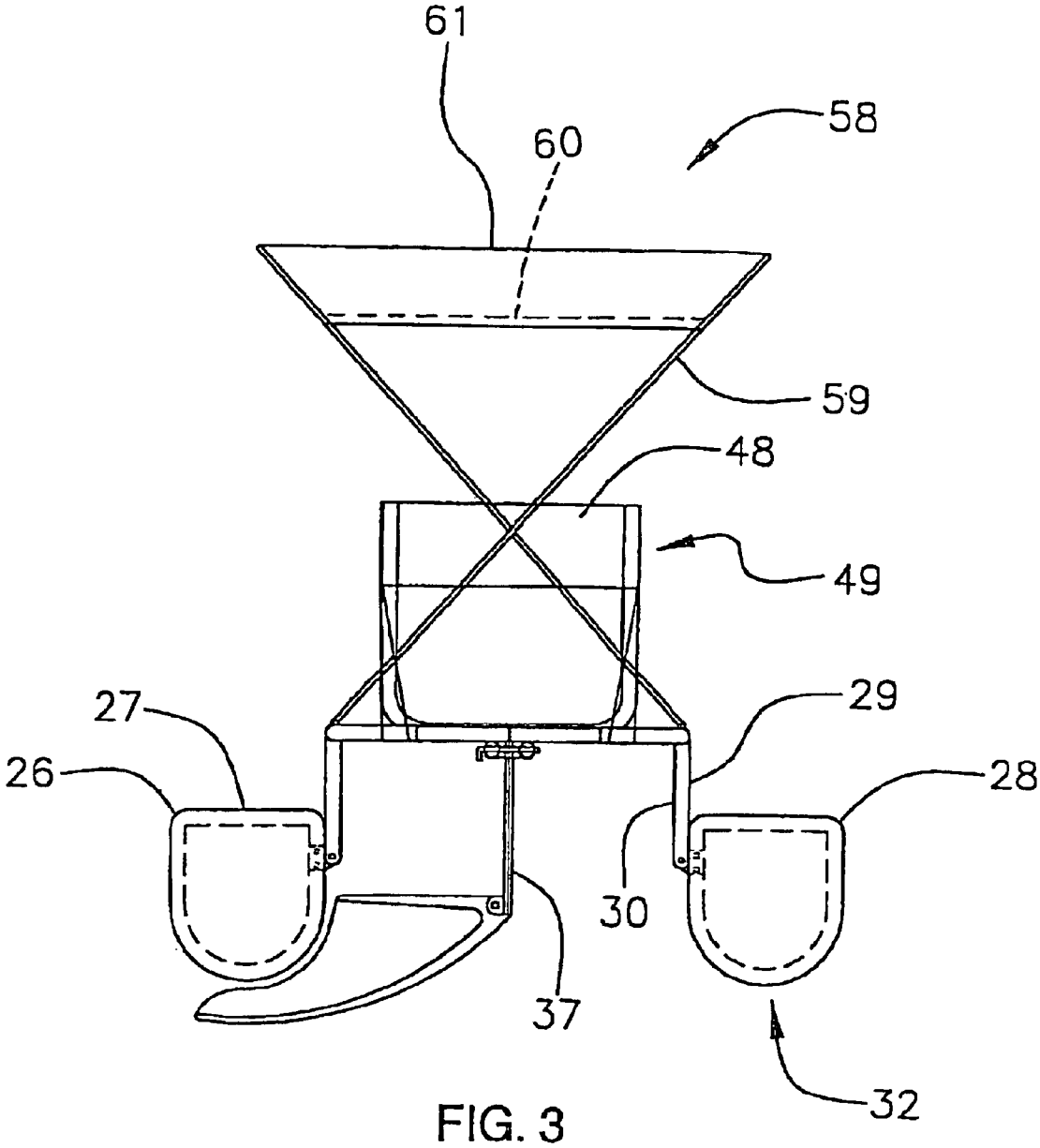
FIG. 3 is a schematic rear view of the present invention.
Figure 4:
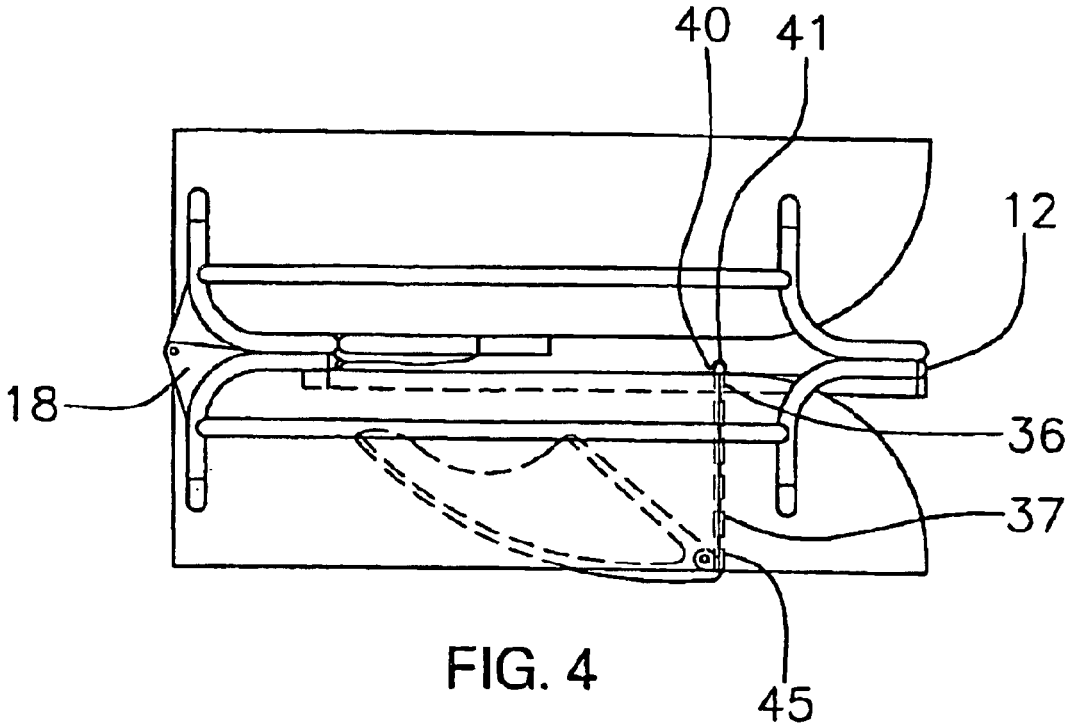
FIG. 4 is a schematic side view of the present invention in a collapsed position.
Figure 5:
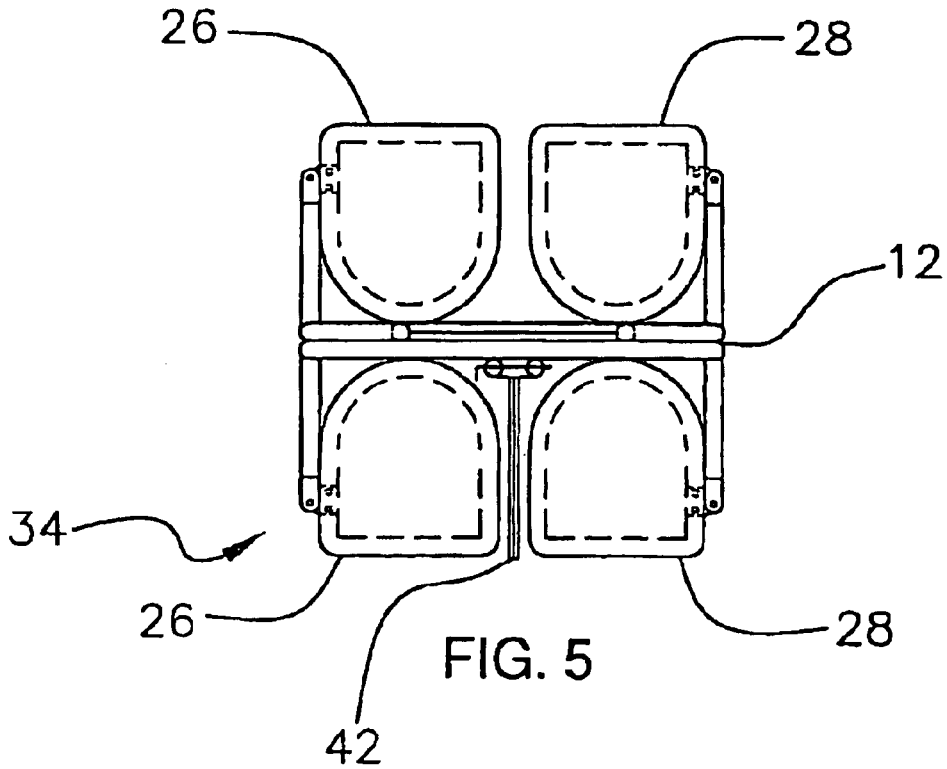
FIG. 5 is a schematic end view of the present invention in a collapsed position.
Figure 6:
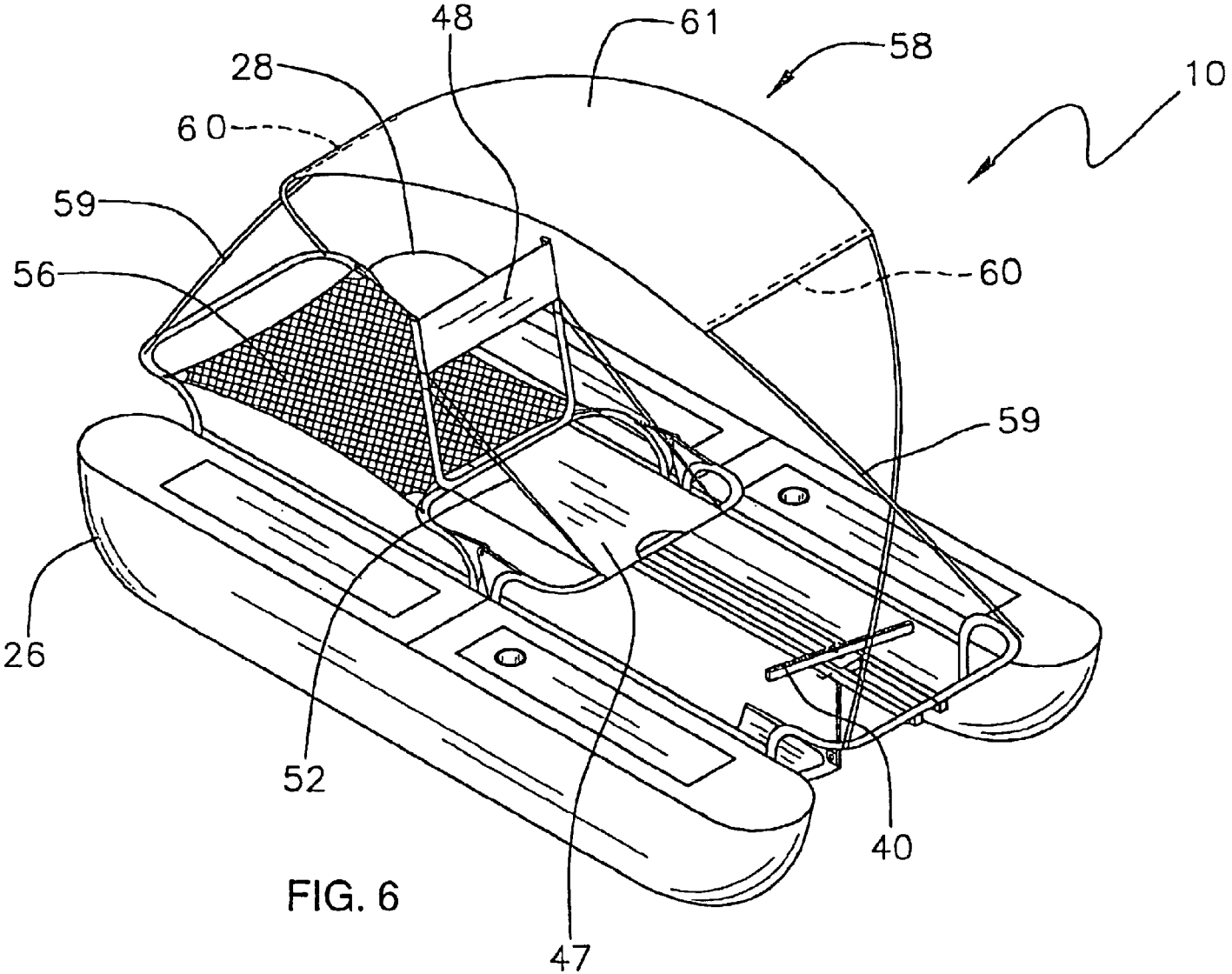
FIG. 6 is a schematic perspective view of the present invention without the cover assembly.

With reference now to the drawings, and in particular to FIGS. 1 through 6 thereof, a new collapsible watercraft embodying the principles and concepts of the present invention and generally designated by the reference numeral 10 will be described.

As best illustrated in FIGS. 1 through 6, the collapsible watercraft 10 generally comprises a tubular frame assembly 12 that has a first portion 13 and a second portion 14. Each of the portions 13, 14 is generally rectangular and are hingably coupled together. Each of the portions 13, 14 comprises a pair of side bars 15, an inner end bar 16, an outer end bar 17, and a plurality of hinge members 18.

Each of the inner and outer end bars 16, 17 has a pair of ends 20 and a center section 24. Each of the ends 20 has a lower portion 21 and an upper portion 22. The center section 24 is integrally coupled to and extends between each of the upper portions 22. Each of the side bars 15 is fixedly coupled to and extends between the lower portions 21 of each of the ends 20 of each of the end bars.

Each of the hinge members 18 is fixedly coupled to each of the upper portions 22 of the ends 20 of the inner end bars 16 such that the first and the second portions 13, 14 are hingably coupled together.

A first pair of floatation members 26 and a second pair of floatation members 28. Each of the pairs of floatation members 26, 28 is hingably attached to an outer side 29 of the end bars of the frame assembly 12 such that each of the floatation members is pivotable between a first position 32 and a second position 34.

The first position 32 is when each of the floatation members are located adjacent the outer side 29 of each of the end bars, and the second position 34 is when each of the floatation members are located adjacent an inner side 30 of each of the end bars.

Each of the floatation members is elongated and has an upper side 27 that has a compartment 32 therein.

A steering and propulsion assembly 34 is fixedly coupled to the first portion 13 of the frame assembly 12 and is located between the inner and outer end bars 17, 18 of the first portion 13.

The steering and propulsion assembly 34 comprises a pair of support bars 35, a mounting 36 that is fixedly coupled to and extends between each of the support bars 35, a rod 37 that extends through a top side 38 and bottom side 39 of the mounting 36 and is rotatably coupled to the mounting 36, a push bar 40 that is attached to and extends in opposite directions away from a first end 41 of the rod 37, and a fin 42 that has a leading end 43 and a trailing end 44.

Each of the support bars 35 is fixedly coupled to and extends between each of the center sections 24 of the inner end bar 16 and the outer end bar 17. The support bars 35 are spaced apart and are centrally positioned on each of the center sections 24. The support bars 35 are generally parallel to each of the side bars 15.

The first end 41 of the rod 37 is positioned above the top side 38 and a second end 45 of the rod 37 is positioned below the bottom side 39 of the mounting 36.

The leading end 43 of the fin 42 is pivotally coupled to the second end 45 of the rod 37 such that the fin 42 is selectively positionable along a plane orientated parallel to a longitudinal axis of the rod 37. The fin 42 is extendable into the water when each of the flotation members are supporting the frame assembly 12 above the water.

The fin 42 may be oscillated back and forth when a user simultaneously oscillates the push bar 40 to selectively move the frame assembly 12 in the water. The fin 42 also functions as a rudder for steering.

A flexible panel 46 for supporting the user is attached to and extends between the center sections 24 of the inner end bars 16 of each of the first and second portions 14. The flexible panel 46 comprises a fabric material and defines a seat 47.

A backrest 48 for supporting the back of the user has a top section 49 and a bottom section 50. The bottom section 50 is pivotally coupled to and extends upwardly from the center section 24 of the inner end bar 16 of the second portion 14 such that the backrest 48 is rotatable downward onto the seat 47. The backrest 48 comprises a cushion.

A pair of flexible restraint members 52 limits rotation of the backrest 48. Each of the restraint members 52 is fixedly coupled to outer portions 54 of the seat 47 and the backrest 48 such that when the backrest 48 is rotated away from the seat 47 each of the restraint members 52 becomes taut.

A net 56 for supporting cargo is attached to each of the ends 20 of the inner end bar 16 and the outer end bar 17 of the second portion 14.

A cover assembly 58 for protecting the user from the elements is releasably attachable to the center sections 24 of each of the outer end bars 17 of the frame assembly 12. The cover assembly 58 comprises a pair of side poles 59, a plurality of support poles 60, and a canopy member 61.

The cover assembly 58 has a width generally equal to a width of each of the outer end bars 17. The cover assembly 58 arches upwardly over the backrest 48.

The side poles 59 are selectively couplable to and extend between the ends 20 of the outer end bars 17. Each of the side poles 59 is generally arcuate.

The support poles 60 are attached to and extend between each of the side poles 59. Each of the support poles 60 is generally perpendicular to each of the side poles 59.

The canopy member 61 is attached to and extends over each of the side poles 59 and support poles 60. The cover comprises a semitransparent material.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible watercraft for personal recreation, said watercraft comprising:

a tubular frame assembly having a first portion and a second portion, each of said portions comprising a pair of side bars, an inner end bar, an outer end bar, and a plurality of hinge members;

a first pair of floatation members and a second pair of floatation members, each of said pairs of floatation members being hingably attached to an outer side of said end bars of said frame assembly;

a steering and propulsion assembly being fixedly coupled to said first portion of said frame assembly, said steering and propulsion assembly comprising a pair of support bars, a mounting being fixedly coupled to and extending between each of said support bars of said first portion, a rod being rotatably coupled to said mounting, a push bar being attached to and extending in opposite directions away from said first end of said rod, a fin having a leading end and a trailing end;

a flexible panel for supporting the user being attached to and extending between said inner end bars of each of said first and second portions;

a backrest for supporting the back of the user;

a pair of flexible restraint members for limiting rotation of said backrest;

a net for supporting cargo being attached to said inner end bar and said outer end bar of said second portion; and a cover assembly for protecting the user from the elements being releasably attachable to said center sections of each of said outer end bars of said frame assembly, said cover assembly comprising a pair of side poles, a plurality of support poles, and a canopy member.

2. The collapsible watercraft as set forth in claim 1, further comprising each of said portions being generally rectangular, said first and second portions being hingably coupled together.

3. The collapsible watercraft as set forth in claim 1, further comprising wherein each of said inner and outer end bars has a pair of ends and a center section, each of said ends has a lower portion and an upper portion, said center section is integrally coupled to and extends between each of said upper portions, each of said side bars is fixedly coupled to and extends between said lower portions of each of said ends of each of said end bars, said flexible panel being attached to and extending between said center sections of said inner end bars.

4. The collapsible watercraft as set forth in claim 3, further comprising each of said hinge members being fixedly coupled to each of said upper portions of each of said ends of said inner end bars such that said first portion and said second portion are hingably coupled together.

5. The collapsible watercraft as set forth in claim 3, further comprising each of said support bars being fixedly coupled to and extending between each of said center sections of said inner end bar and said outer end bar, each of said support bars being spaced apart and being centrally positioned on each of said center sections, said support bars being generally parallel to each of said side bars.

6. The collapsible watercraft as set forth in claim 3, further comprising said backrest having a top section and a bottom section, said bottom section being pivotally coupled to and extending upwardly from said center section of said inner end bar of said second portion such that said backrest is rotatable downward onto said panel, said backrest comprising a cushion.

7. The collapsible watercraft as set forth in claim 3, further comprising each of said side poles being selectively couplable to and extending between said ends of said outer end bars, each of said side poles being generally arcuate.

8. The collapsible watercraft as set forth in claim 1, further comprising each of said floatation members is pivotable between a first position and a second position, wherein said first position is when each of said floatation members are located adjacent said outer side of each of said end bars and said second position is when each of said floatation members are located adjacent an inner side of each of said end bars, each of said floatation members being elongated, each of said floatation members having an upper side having a compartment therein.

9. The collapsible watercraft as set forth in claim 1, further comprising said steering and propulsion assembly being located between said inner and outer end bars of said first portion.

10. The collapsible watercraft as set forth in claim 1, further comprising said mounting having a top side and a bottom side such that said rod extends through said top and bottom sides.

11. The collapsible watercraft as set forth in claim 10, further comprising said rod having a first end and a second end, wherein said first end is positioned above said top side and said second end is positioned below said bottom side.

12. The collapsible watercraft as set forth in claim 11, further comprising said leading end being pivotally coupled to said second end of said rod such that said fin is selectively positionable along a plane orientated parallel to a longitudinal axis of said rod, said fin being extendable into the water when each of said flotation members are supporting said frame assembly above the water.

13. The collapsible watercraft as set forth in claim 1, further comprising wherein said fin may be oscillated back and forth when a user simultaneously oscillates said push bar to selectively move said frame assembly in the water, wherein said fin also functions as a rudder for steering.

14. The collapsible watercraft as set forth in claim 1, further comprising said flexible panel comprising a fabric material, said panel defining a seat.

15. The collapsible watercraft as set forth in claim 1, further comprising each of said restraint members being fixedly coupled to outer sides of said panel and said backrest such that when said backrest is rotated away from said panel each of said restraint members become taut.

16. The collapsible watercraft as set forth in claim 1, further comprising said cover assembly having a width generally equal to a width of each of said outer end bars, said cover assembly arching upwardly over said backrest.

17. The collapsible watercraft as set forth in claim 1, further comprising said support poles being attached to and extending between each of said side poles, each of said support poles being generally perpendicular to each of said side poles.

18. The collapsible watercraft as set forth in claim 1, further comprising said canopy member being attached to and extending over each of said side poles and support poles, said cover comprising a semitransparent material.

19. A collapsible watercraft for personal recreation, said watercraft comprising:

a tubular frame assembly having a first portion and a second portion, each of said portions being generally rectangular, said first and second portions being hingably coupled together, each of said portions comprising a pair of side bars, an inner end bar, an outer end bar, and a plurality of hinge members;

wherein each of said inner and outer end bars has a pair of ends and a center section, each of said ends has a lower portion and an upper portion, said center section is integrally coupled to and extends between each of said upper portions, each of said side bars is fixedly coupled to and extends between said lower portions of each of said ends of each of said end bars;

wherein each of said hinge members being fixedly coupled to each of said upper portions of each of said ends of said inner end bars such that said first portion and said second portion are hingably coupled together;

a first pair of floatation members and a second pair of floatation members, each of said pairs of floatation members being hingably attached to an outer side of said end bars of said frame assembly such that each of said floatation members is pivotable between a first position and a second position, wherein said first position is when each of said floatation members are located adjacent said outer side of each of said end bars and said second position is when each of said floatation members are located adjacent an inner side of each of said end bars, each of said floatation members being elongated, each of said floatation members having an upper side having a compartment therein;

a steering and propulsion assembly being fixedly coupled to said first portion of said frame assembly, said steering and propulsion assembly being located between said inner and outer end bars of said first portion, said steering and propulsion assembly comprising;

a pair of support bars, each of said support bars being fixedly coupled to and extending between each of said center sections of said inner end bar and said outer end bar, each of said support bars being spaced apart and being centrally positioned on each of said center sections, said support bars being generally parallel to each of said side bars;

a mounting being fixedly coupled to and extending between each of said support bars of said first portion, said mounting having a top side and a bottom side;

a rod extending through said top and bottom sides and being rotatably coupled to said mounting, said rod having a first end and a second end, wherein said first end is positioned above said top side and said second end is positioned below said bottom side;

a push bar being attached to and extending in opposite directions away from said first end of said rod;

a fin having a leading end and a trailing end, said leading end being pivotally coupled to said second end of said rod such that said fin is selectively positionable along a plane orientated parallel to a longitudinal axis of said rod, said fin being extendable into the water when each of said flotation members are supporting said frame assembly above the water;

wherein said fin may be oscillated back and forth when a user simultaneously oscillates said push bar to selectively move said frame assembly in the water; wherein said fin also functions as a rudder for steering;

a flexible panel for supporting the user being attached to and extending between said center sections of said inner end bars of each of said first and second portions, said flexible panel comprising a fabric material, said panel defining a seat;

a backrest for supporting the back of the user having a top section and a bottom section, said bottom section being pivotally coupled to and extending upwardly from said center section of said inner end bar of said second portion such that said backrest is rotatable downward onto said seat, said backrest comprising a cushion;

a pair of flexible restraint members for limiting rotation of said backrest, each of said restraint members being fixedly coupled to outer sides of said seat and said backrest such that when said backrest is rotated away from said seat each of said restraint members become taut;

a net for supporting cargo being attached to each of said ends of said inner end bar and said outer end bar of said second portion;

a cover assembly for protecting the user from the elements being releasably attachable to said center sections of each of said outer end bars of said frame assembly, said cover assembly having a width generally equal to a width of each of said outer end bars, said cover assembly arching upwardly over said backrest, said cover assembly comprising;

a pair of side poles being selectively couplable to and extending between said ends of said outer end bars, each of said side poles being generally arcuate;

a plurality of support poles being attached to and extending between each of said side poles, each of said support poles being generally perpendicular to each of said side poles; and a canopy member being attached to and extending over each of said side poles and support poles, said cover comprising a semitransparent material.

* * * * *